US006543619B1

(12) United States Patent
Doak et al.

(10) Patent No.: US 6,543,619 B1
(45) Date of Patent: Apr. 8, 2003

(54) METHOD AND APPARATUS FOR SORTING UTILIZING A PRODUCT RAKE AND A RELIEF VALVE

(75) Inventors: Arthur G. Doak, Nashville, TN (US); Paul Gaddis, Seattle, WA (US); Michael Grubbs, Nashville, TN (US)

(73) Assignee: Advanced Sorting Technologies, LLC, Nashville, TN (US)

( * ) Notice: Subject to any disclaimer, the term of this patent is extended or adjusted under 35 U.S.C. 154(b) by 0 days.

(21) Appl. No.: 09/812,421

(22) Filed: Mar. 20, 2001

(51) Int. Cl.[7] ..... B07B 4/00
(52) U.S. Cl. ..... 209/137
(58) Field of Search ..... 209/137, 136, 209/615, 629, 631, 638, 656, 12.1, 19, 20, 26, 27, 34, 35, 134, 133, 138

(56) References Cited

U.S. PATENT DOCUMENTS

| | | | | |
|---|---|---|---|---|
| 2,824,665 A | | 2/1958 | Lamouria | 221/179 |
| 3,240,335 A | * | 3/1966 | Vandenhoeck | 209/136 |
| 3,300,902 A | * | 1/1967 | Dockery | 51/8 |
| 3,329,469 A | | 7/1967 | Stadelman | 302/11 |
| 3,384,233 A | * | 5/1968 | Bolles | 209/12 |
| 3,471,013 A | | 10/1969 | Haver | 209/133 |
| 4,222,859 A | * | 9/1980 | Medlock | 209/143 |
| 4,609,108 A | | 9/1986 | Hristozov et al. | 209/581 |
| 5,339,964 A | | 8/1994 | Gray et al. | 209/587 |

FOREIGN PATENT DOCUMENTS

| | | | |
|---|---|---|---|
| DE | 43 20 362 A1 * | 12/1994 | B07B/4/04 |

* cited by examiner

*Primary Examiner*—Donald P. Walsh
*Assistant Examiner*—Mark J. Beauchaine
(74) *Attorney, Agent, or Firm*—Waddey & Patterson; Lucian Wayne Beavers

(57) ABSTRACT

An apparatus and method for reducing the circling upward movement of a product such as waste paper entrained in a carrier stream. The invention includes a product rake placed within a discharge chute to capture and direct product within the product flow. A further aspect of the invention includes a relief valve integrated into the discharge chute to alleviate pressure in the discharge chute and allow excess air to be relieved from the discharge chute to control the product flow.

27 Claims, 6 Drawing Sheets

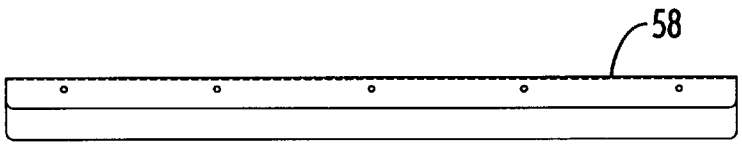
FIG. 6
FIG. 5
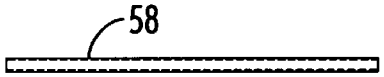
FIG. 7
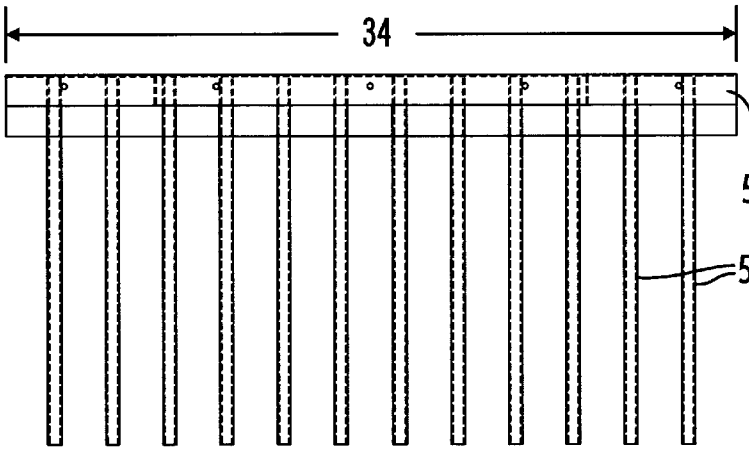
FIG. 10
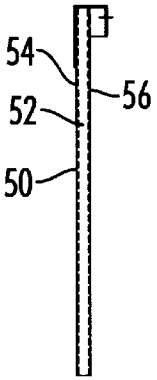
FIG. 9
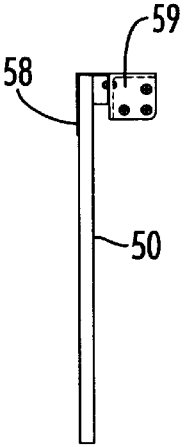
FIG. 8
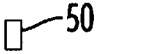
FIG. 11
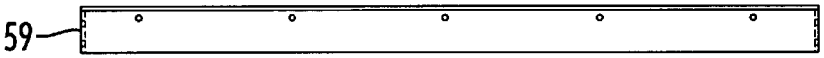
FIG. 13
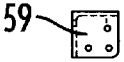
FIG. 12

METHOD AND APPARATUS FOR SORTING UTILIZING A PRODUCT RAKE AND A RELIEF VALVE

BACKGROUND OF THE INVENTION

The present invention relates generally to a sorting system with air flow control. More particularly, this invention pertains to improvements in an apparatus and method for controlling air flow and product sorting in an air control sorting system.

Several United States Patents are directed to conveyors and sorting devices. These include U.S. Pat. No. 2,824,665, issued to Lamouria on Feb. 25, 1958; U.S. Pat. No. 3,329,469, issued to Stadelman on Jul. 4, 1967; U.S. Pat. No. 3,471,013, issued to Haver on Oct. 7, 1969; U.S. Pat. No. 4,609,108, issued to Hristozov et al. on Sep. 2, 1986; and U.S. Pat. No. 5,339,964, issued to Gray et al. on Aug. 23, 1994. One patent worth noting is U.S. Pat. No. 5,339,964, issued to Gray et al. and assigned to SIMCO/Ramic Corporation which discloses a discharge chute which has vents 44 and 45 which allow air to escape from the discharge chute. However, this patent is limited in its teachings because it fails to teach the advantages of the present invention.

The prior art fails to teach the advantages the present invention in controlling the movement of the rejected waste product in the discharge chute product flow through the utilization of a product rake and/or relief valves. Therefore, what is needed is an improved method and apparatus for controlling the movement of product in an entraining carrier stream.

SUMMARY OF THE INVENTION

The present invention is directed to a modification of a discharge chute with a product rake and/or a relief valve to prevent the circling upward movement of waste paper from product flow within the discharge chute.

One preferred embodiment of the present invention utilizes a product rake for dragging the variable product flow for separating the product from the entraining carrier stream. The preferred design of the product rake includes one or more fingers that project into the product flow. The finger(s) are adapted to capture the product as combings during product flow and direct the combings to a discharge area.

A method is taught by the present invention for controlling the flow of a product entrained in a carrier stream within a housing. The method includes providing a carrier-permeable, but product-impermeable capturing barrier that is mounted within the housing; capturing the product with the barrier during a product flow period, and allowing the product to leave the barrier.

Another improvement of the present invention utilizes an auxilary blower which is adapted to provide a slight updraft of the air from the discharge chute into the main air stream of paper to minimize unwanted paper entering the chute. Another improvement to the present invention utilizes a relief valve mounted in the wall of the discharge chute and adapted to relieve excess air pressure in the chute to reduce blow back of discharge paper from the chute into the main air stream. The relief valve includes a valve frame mounted to the discharge chute that forms a flow opening out of the discharge chute. The flow opening is used to exhaust at least a portion of the product flow or carrier from the discharge chute. The flow opening is covered by a valve flap that is hingably mounted to the valve frame. The valve flap is adapted to selectively adjust the exhausting of the product flow through the flow opening in relation to the pressure of the product flow within the exhaust discharge chute. The relation of the exhaust flow to the pressure may be modified or controlled by a flow vane operating in association with the valve flap. This pressure reduction can be used to control the flow of the product flow within the discharge chute.

A method is also taught by the present invention for reducing the return product flow from the discharge chute to the main air stream caused by the eddy flow within an airstream inside an enclosure. This method includes providing an exhaust path from the enclosure for the airstream in the area of the eddy current.

BRIEF DESCRIPTION OF THE DRAWINGS

FIG. 5 is an end view of a finger support frame.

FIG. 6 is a back of the finger support frame.

FIG. 7 is a top view of the finger support frame.

FIG. 8 is a side view of the product rake with a mounting gusset.

FIG. 9 is a side view of the product rake.

FIG. 10 is a front view of the product rake.

FIG. 11 is end view of a finger of the product rake.

FIG. 12 is a side view of a mounting gusset mounted on the finger support frame.

FIG. 13 is a back view of the mounting gussets mounted on the finger support frame.

DESCRIPTION OF THE PREFERRED EMBODIMENTS

Figure 1:
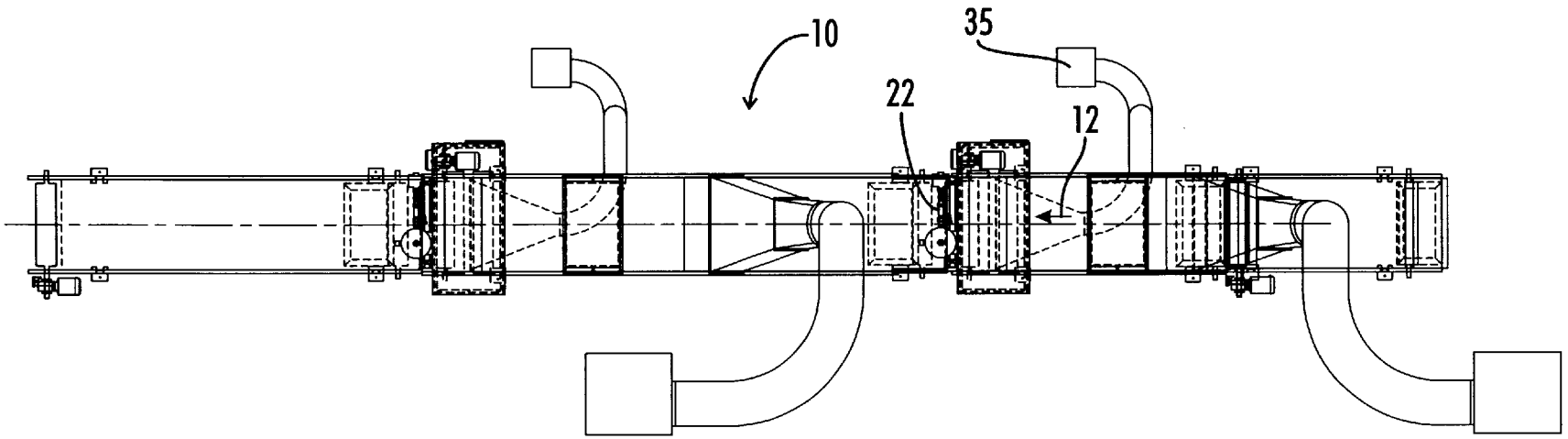
FIG. 1 is a top elevational view of the general layout of an air control system.
Figure 2:
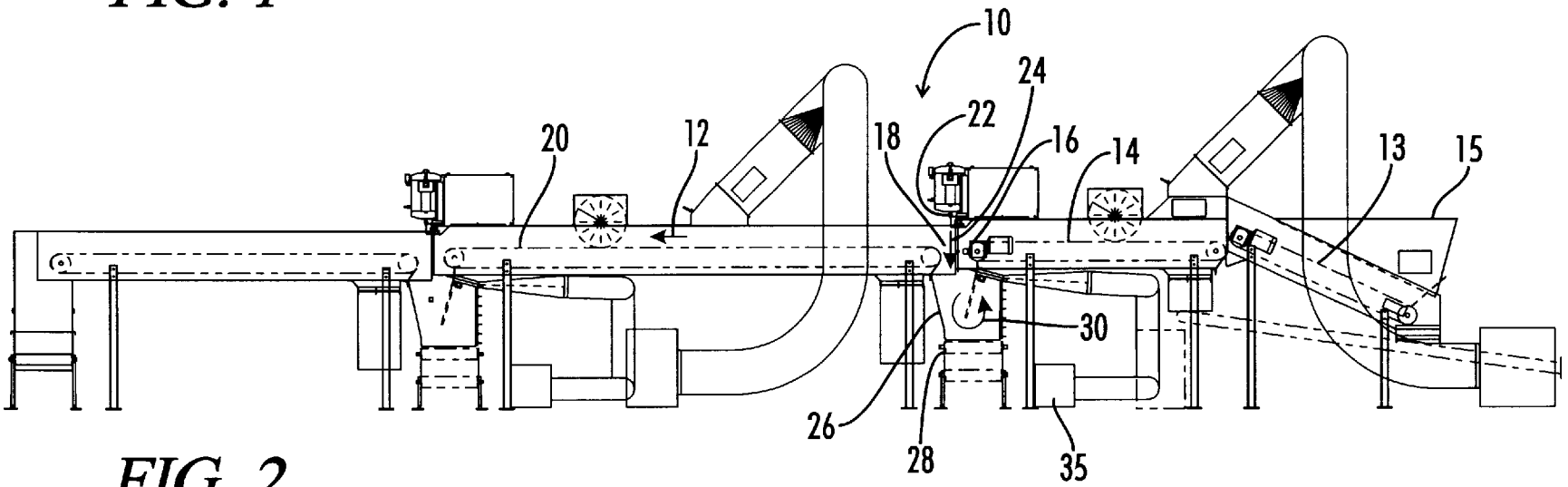
FIG. 2 is a side plan view of the general layout of an air control system.

The paper sorting systems of the present invention utilizes an entraining air flow to sort a paper stream. The problem resolved by the present invention may be understood by examining FIGS. 1 and 2 which show a paper sorting system utilizing the present invention. FIG. 1 is a top elevational view and FIG. 2 is a side plan view of a paper sorting conveyor system generally designated by the numeral 10. As seen in FIGS. 1 and 2, the paper sorting conveyor system 10 is used for sorting a product entrained in a carrier stream. The product is typically a waste paper product characterized by a large product surface area in relation to product weight. The product and an associated carrier stream of air will travel from right to left in an initial product stream across the conveyor in the direction indicated by the arrow 12. Mixed paper enters the system 10 much like a manual sorting line. An infeed conveyor 13 from a pit 15 takes the paper up to the system 10. The system 10 first employs various mechanical techniques to reduce burden, depth, and provide a uniform, metered, and single layer feed stream of papers to a sensor module (not shown). During the normal non-sorting process flow, the waste paper first moves along a first conveyor belt 14 and is thrown off of the left end 16 of conveyor belt 14 across a gap 18 to land on top of a second conveyor belt 20. The first conveyor 14 and the second conveyor 20 define an air space as the gap 18 between the conveyors 14, 20. An auxiliary blower 35 is positioned and adapted to provide a slight updraft of the air from the discharge chute 26 into the main air stream of paper to minimize unwanted paper entering the chute 26. As described for the present invention, the primary destination includes a second conveyor 20 adapted to receive the main air stream of paper. These conveyors systems 14, 20 are generally high speed designs adapted to transport large volumes of paper quickly. The sensor module is used to identify the optical properties of the paper to determine a premium value according to paper type, size, and position data. The sensor module provides information to a central computer that operates a series of precision air nozzles 22 across the gap 18 to provide automatic removal of the selected paper grades. The system creates blasts of air from the air nozzles 22 to create a product flow into the discharge chute 26. The discharge chute of the present invention includes at least one wall 27 defining the discharge chute 26 located below the air space. During the sorting aspect of the process flow, an air eject nozzle 22 will be periodically actuated to direct a jet of air, indicated by arrow 24 to blow selected product, such as waste paper, downward into the discharge chute 26 which will direct the product onto a third conveyor 28. The system 10 can be provided with a second sensor array in series with the first one for removal of a second premium grade of paper, or as a second pass for improved product purity. The present invention is designed to implement improvements to the product flow during transportation into and through the discharge chute 26. The problem addressed by the invention is that the downward movement of the product flow through the gap 18 into the discharge chute 26 tends to cause the air and paper to move in a circular swirling pattern as indicated by arrow 30. This tends to cause some of the rejected waste product entrained in the product flow to move back upward up through the gap 18 and return to the initial product stream on conveyor 20. The return of the rejected waste product back onto the initial product stream 12 is not desirable.

As shown in FIGS. 1–4 of the present invention, the product flow through the discharge chute 26 has been modified in two ways to prevent the circling upward movement of waste paper along the path 30. First, a product rake 32, shown as the preferred embodiment of a grid of bars 32, has been placed within the discharge chute 26 so that incoming paper will collect on the front surface of the bars 32 and upwardly swirling paper along path 30 will collect on the back surfaces of the bars 32 and will then fall downward off of the bars 32 through the chute 26 onto the lower conveyor belt 28. Second, a relief valve 40, shown in the preferred embodiment of a flapper controlled outlet 40, has been integrated into the backside of the discharge chute 26 to deal with the problem of waste paper blowing back up out of the discharge chute 26 by alleviating pressure in the discharge chute 26. Thus, the present invention teaches the use of a bar grid or product rake 32 which physically prevents backflow of discharged articles due to swirling airflow 30; and the use of a flapper type air check valve or similar relief valve 40 which allows excess air to be relieved from the discharge chute 26.

The present invention is directed toward a paper conveying system 10 which includes a first conveyor 14 arranged to launch a main air stream of paper across an air space 18 toward a primary destination 20. A discharge chute 26 is located below the air space 18 and an air jet 22 is directed at the air space 18 for diverting selected pieces of paper from the main air stream through the air space 18 and away from the primary destination 20 and into the discharge chute 26. The invention also includes a product rake 32 which projects into the discharge chute 26 to prevent paper discharged into the chute 26 from blowing back out of the chute 26 into the main air stream. The product rake 32 of the present invention includes a finger support frame 58 attached to the discharge chute 26 and multiple fingers 50 attached to the finger support frame 58.

Figure 4:
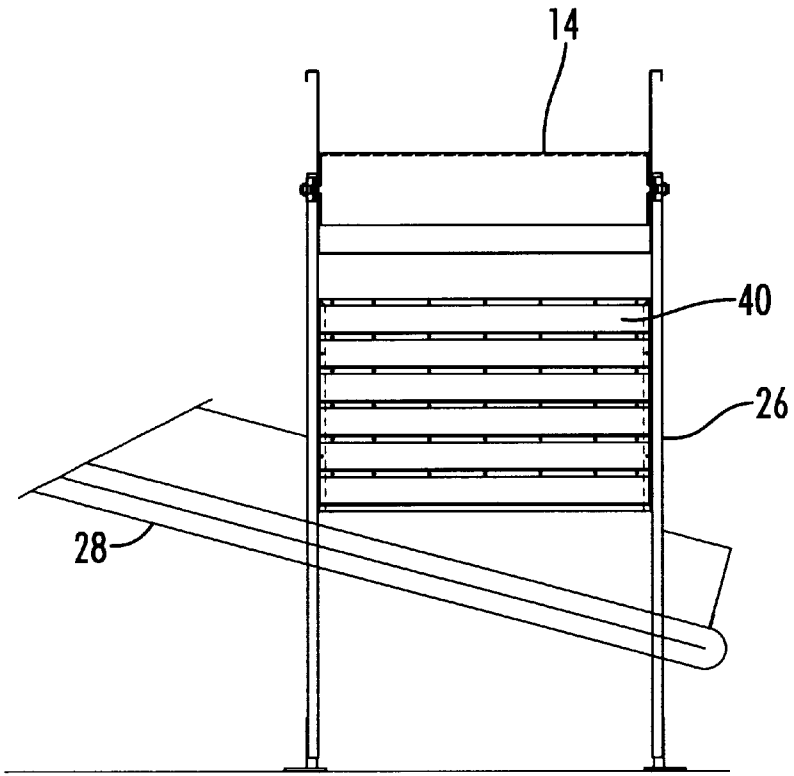
FIG. 4 is a back view of the discharge chute of the air control system showing the positioning of the relief valve.
Figure 3:
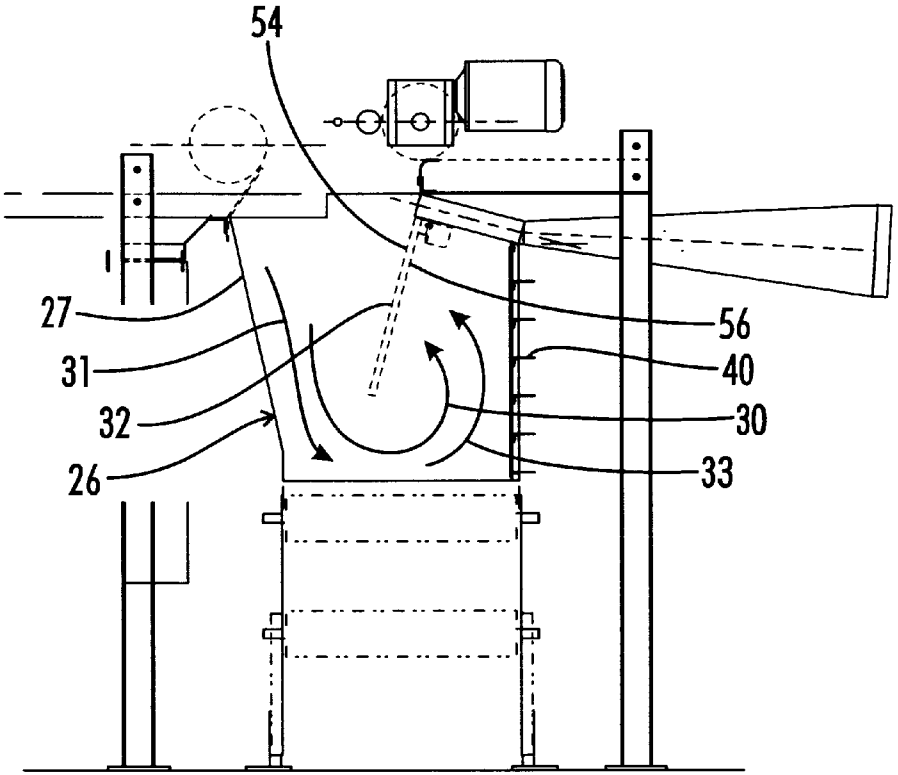
FIG. 3 is an enlarged view of the discharge chute of the air control system including a product rake and a relief valve.
Figure 16:
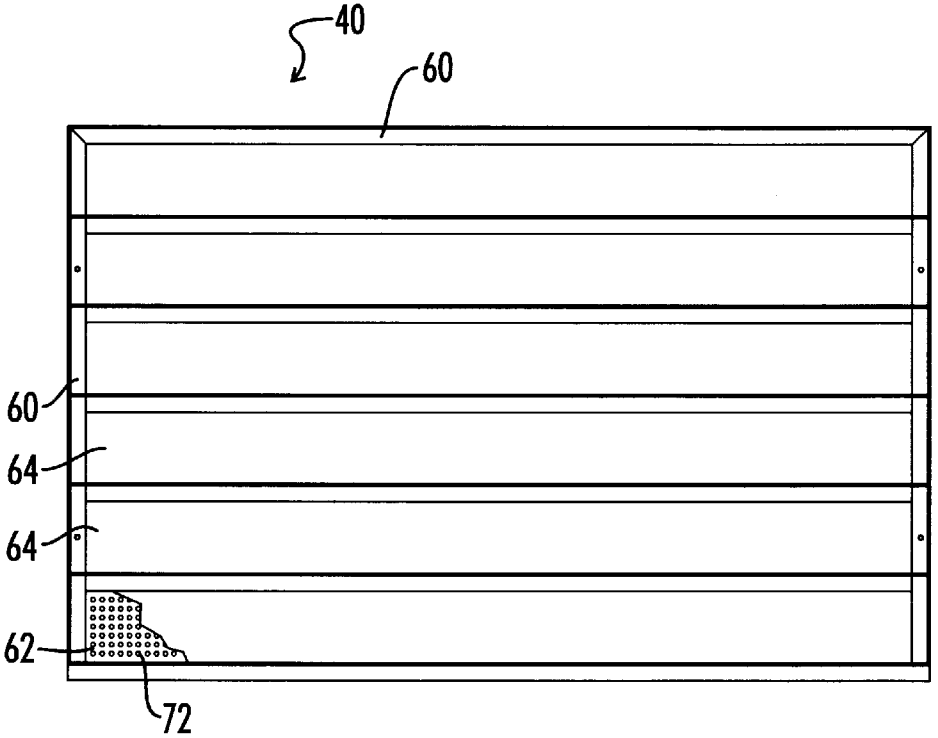
FIG. 16 is a back view of the carrier-product separation device mounted on the relief valve with a cutaway view of the valve flap showing the carrier-product separation device.
Figure 15:
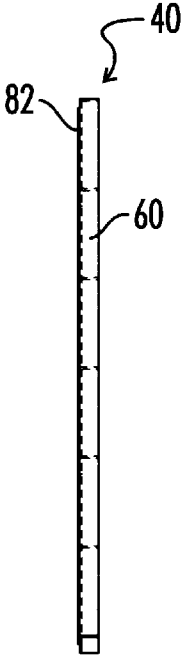
FIG. 15 is a side view of the carrier-product separation device mounted on the relief valve.
Figure 14:
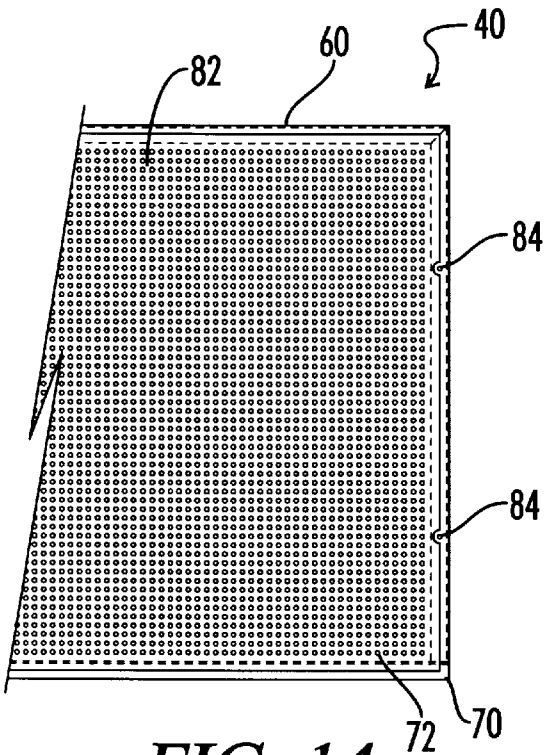
FIG. 14 is a front cutaway view of the carrier-product separation device used on the relief valve.

FIGS. 5 through 13 show the preferred embodiment of the product rake 32 for dragging the variable product flow 30 for separating the product from the entraining carrier stream. The product rake 32 includes one or more fingers 50 that project into the product flow. The finger(s) 50 are adapted to capture the product as combings and direct the combings to a discharge. FIG. 10 shows an elevation view of the grid of bars 32. The grid 32 has a width 34 which extends across the width of the discharge chute 26 shown in the plan view of FIG. 2. As shown in FIGS. 2 and 4, the product rake 32 is mounted at an angle of fifteen degrees to vertical to extend into the product flow 30. Thus, the product rake 32 is mounted at an angle to the wall 27 of the discharge chute 26. As noted by the placement of the rake 32 in relation to the initial downward motion of the product flow in FIG. 2, the product rake 32 is placed at an angle that is obtuse to the product flow. The rake 32 is spaced from the side of the discharge chute 26 and above the discharge conveyor 28 to allow for the product to flow past the rake 32. The product rake 32 is positioned in the discharge chute 26 to direct combings leaving the product rake 32 away from the primary destination 20.

The finger 50 of the rake 32 is designed with a main body 52 projecting into a primary flow 31 of the product flow 30 and adapted to encourage the development of a secondary eddy flow 33 within the product flow 30. The finger 50 of the rake 32 acts like an obstruction in a river which creates an eddy current behind the obstruction. This main body 52 supports a first surface 54 on the primary flow 31 side of the product rake 32. The first surface 54 is positioned to capture combings from the primary flow 31. A second surface 56 is supported on the secondary eddy flow 33 side of the main body 52. The second surface 56 is positioned to capture combings from the secondary eddy flow 33 of the product flow 30. Both the first surface 54 and the second surface 56 utilize smooth surfaces that are positioned in the discharge chute 26 to utilize gravity clearing of the combings from the product rake during the product flow 30.

For the present invention, the product flow 30 will provide sufficient flow to drive a product or piece paper entrained in the carrier stream into the discharge chute 26. This product may then be driven against either the first surface 54 or second surface 56 of the product rake 32 to become a combing, or may bypass the rake entirely to travel to the discharge conveyor 28. For the product that is captured by the rake 32, a high product flow 30 may provide sufficient force to increase the frictional force between the combing and the product rake 32 to hold the combing on one of the surfaces 54, 56 of the product rake 32. To allow for discharge of the combing from the rake, the present invention is designed to be utilized with a product flow 30 that has either a permanent or at least a temporary period of low product flow 30 that allows for either the force of gravity or the product flow 30 to overcome the friction between the combing and the product rake 32. This allows for either the force of gravity or the product flow 30 to remove combings from the product rake 32 such that the rake 32 may continue to capture additional combings without clogging.

For the wide discharge chute 26 of the present invention, the product rake 32 is designed with multiple fingers 50 supported on a finger support frame 58 and mounted with gussets 59 attached to the chute 26. The finger support frame 58 is shown as a generally "J" shaped extension with sufficient opening in the bottom 61 of the "J" to accept the fingers 50. The fingers 50 may be attached to the finger support frame 58 in any manner, although welding is the preferred method of attachment. The gussets 59 are attached to the ends of the finger support frame 58 and adapted to mount the product rake 32 to the discharge chute 26.

The present invention thus provides a method for separating a product that is entrained in an carrier stream of a product flow within a housing. The method includes providing an carrier-permeable and product-capturing barrier, such as a product rake 32, that is mounted within the housing of the discharge chute 26. Then, capturing the product with the barrier 32 during any type of flow period of the product flow; and finally, allowing the product to leave the barrier during low flow periods of the product flow. A further method may then be added to this basic method by creating a secondary eddy flow 33 of the product entrained in the carrier stream, then capturing the product with the barrier 32 from the secondary eddy flow 33 during any flow period of the secondary eddy flow 33; and finally, allowing the product to leave the barrier 32 during low flow periods of the secondary eddy flow 33.

Another advantageous embodiment of the present invention discloses a paper conveying system 10 which includes a conveyor 14 arranged to launch a main air stream of paper across an air space 18 toward a primary destination 20. A discharge chute 26 is located below the air space 18 and includes a wall 27. An air jet 22 is directed at the air space 18 for diverting selected pieces of paper from the main stream away from the primary destination 20 and through the air space 18 into the discharge chute 26 to form a discharge stream. And finally, a relief valve 40 is mounted in the side wall 27 of the chute 26 to relieve excess air pressure from the chute 26 so as to reduce blow back of the discharged paper from the chute 26 into the main stream. The relief valve 40 includes a valve frame 60 forming a flow opening 26 for exhausting the excess air pressure with the valve frame 60 supportively mounted to the discharge chute 26. The relief valve 40 also includes a valve flap 64 which is hingably mounted to the valve frame 60 and adapted to cover the flow opening 62. As shown in its preferred embodiment, the relief valve 40 is configured as a flapper outlet 40 for controlling the product flow 30 in the exhaust discharge chute 26. The relief valve 40 includes a valve frame 60 mounted to the discharge chute 26 that forms a flow opening 62 out of the discharge chute 26. The flow opening 62 is used to exhaust at least a portion of the product flow 30 from the discharge chute 26. The flow opening 62 is covered by a valve flap 64 made from a flexible material that allows for a hingable mounting to the valve frame 60. Thus, for the preferred embodiment, the valve flap 64 forms the hinge. However, it is also envisioned that additional elements could be utilized to form the hingable mounting. The resistance to movement provided by the predisposure of the hinge material to remain straight, the force of gravity on the hinge material, and the negative pressure in the discharge chute created by the passage of the initial product stream 12 across the top of the discharge chute 26, work to keep the valve flap 64 in a closed position. This predisposition to the closed position allows the valve flap 64 to selectively adjust the pressure in the discharge chute 26 by exhausting the product flow 30 through the flow opening 62. This reduction in pressure is performed in relation to the pressure of the product flow 30 within the exhaust discharge chute 26. This pressure reduction can be used to control the product flow 30 within the discharge chute by selectively reducing pressure and thus, selectively removing the force of the product flow.

Figure 20:
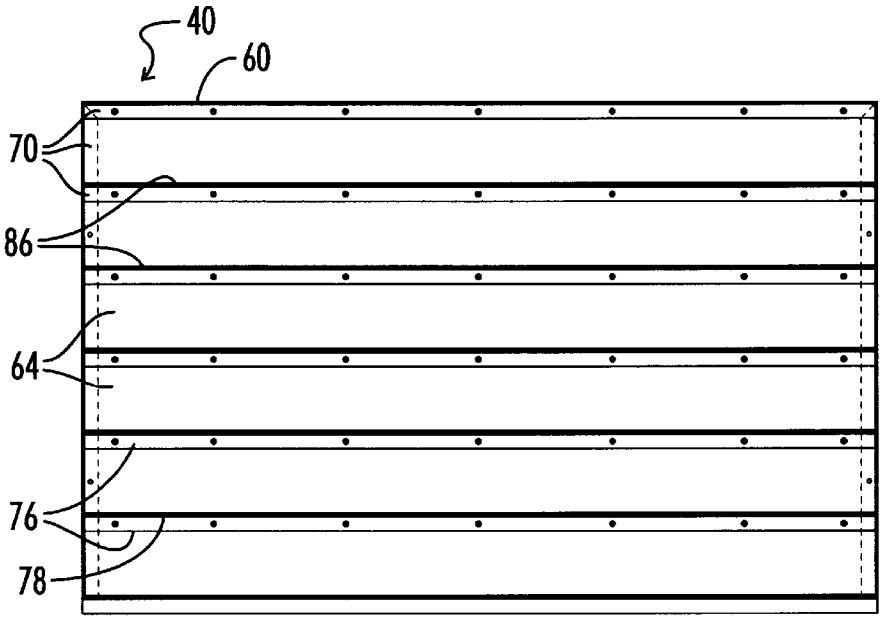
FIG. 20 is a front view of the relief valve.
Figure 21:
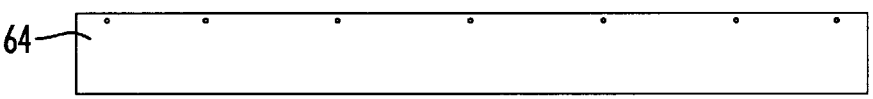
FIG. 21 is a front view of the valve flap before mounting on the relief valve.
Figure 19:
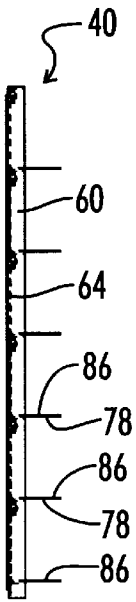
FIG. 19 is a side view of the relief valve with closed valve flaps.
Figure 17:
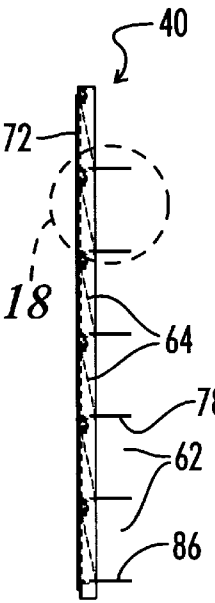
FIG. 17 is a side view of the relief valve with partially open valve flaps.
Figure 18:
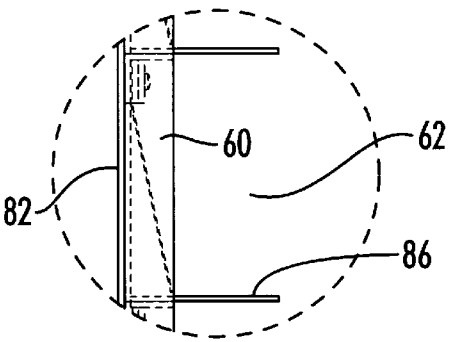
FIG. 18 is an enlarged view of a partially open valve flaps shown in FIG. 17.

FIGS. 14 through 21 show the preferred embodiment of the flapper outlet 40. A metal framework 70 of the frame 60 holds a carrier-product separation device 72 and supports a plurality of valve flaps 64 or flappers 64. The carrier-product separation device 72 is shown in the preferred embodiment of a perforated plate 72. Each flapper 64 is shown in the preferred embodiment of a strip of flexible cloth-like material which is attached to the framework 70 by any appropriate means, such as by the releasable mounting elements or fasteners 84 shown. In this embodiment, six strips of flapper 64 material extend across the width of the discharge chute 26 and are vertically spaced as seen in FIG. 20. Adjacent strips of the flapper gaskets 64 are separated by horizontal metal strips 76 which form flapper backstops 78. The flapper outlet 40 essentially serves as a check valve which will allow excess air from within the discharge chute 26 to be relieved to the surrounding atmosphere. This release of excess air will occur when a plurality of the air jets 22 are actuated to blow paper through the gap 18. This excess air is relieved from discharge chute 26 by the partial opening of the flappers 64. This reduction in the excess air reduces the swirling flow along path 33. The design of the flappers 64, however, will prevent air from being drawn back into the discharge chute 26. In the preferred mounting of the relief valve 40, the product flow will include the primary product flow 31 and a secondary eddy flow 33, and the relief valve 40 will be positionably mounted on the discharge chute 26 to relieve pressure from the secondary eddy flow 33.

Another improvement to the present invention utilizes a carrier-product separation device 72 which is supportively mounted to the relief valve 40 and adapted to restrict the flow of product through the relief valve 40. This carrier product separation device 72 may include a smooth surface 82 facing the product flow and adapted to allow the product to slide off the carrier-product separation device 72. The carrier-product separation device 72 is illustrated as a screen that is supported by and mounted to the framework 70 to cover the flow opening 62. The carrier-product separation device 72 is adapted to allow passage of at least a portion of the carrier or air stream portion of the product flow 30 while restricting the flow of the product through the flow opening 62. The carrier-product separation device 72 is designed to include a smooth surface 82 which faces the product flow 30. This smooth surface 82 is designed to allow the product to slide off of the carrier-product separation device 72 and allow gravity to direct the product further down the discharge chute 26. In the preferred embodiment, the carrier-product separation device 72 forms an open grid with approximately eighty percent open space, and the carrier-product separation device 72 is removably mounted by a releasable mounting element or fastener 84 to the valve frame 70 to allow for removal for cleaning and clearing of the product flow path 30.

Figure 23:
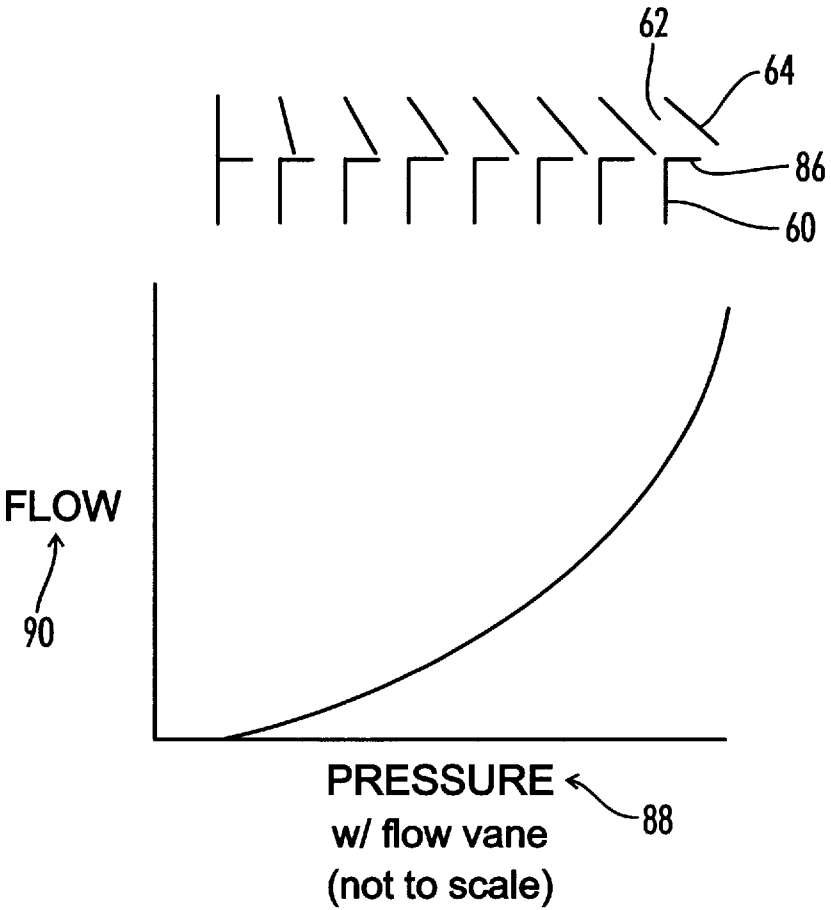
FIG. 23 is a graphic representation of the flow of a valve flap relief valve utilizing a flow vane.
Figure 22:
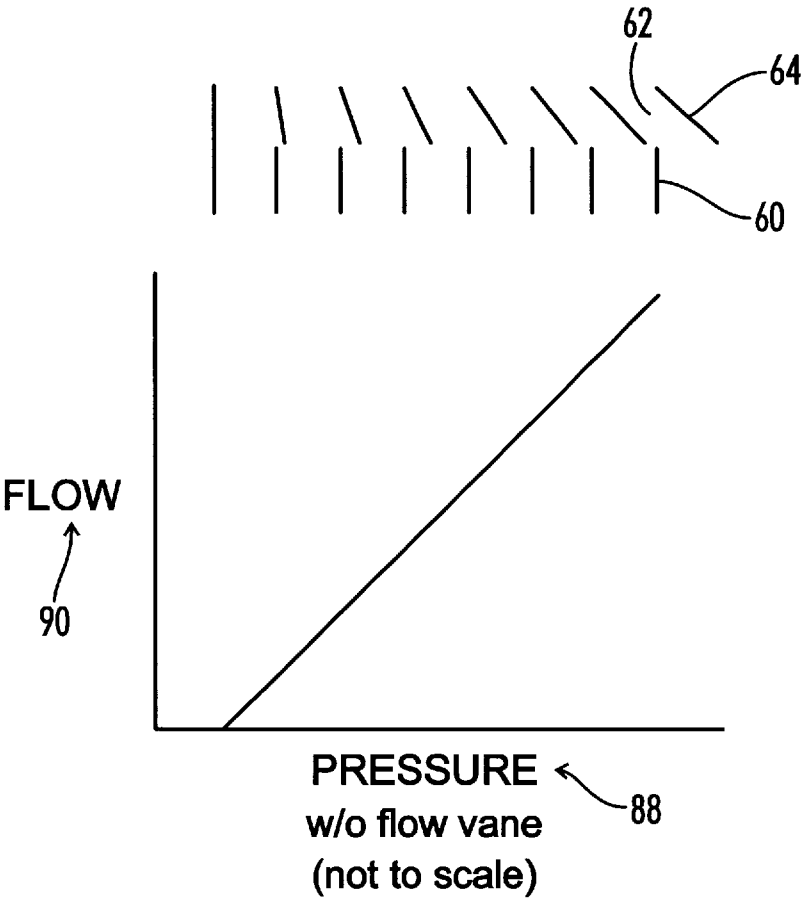
FIG. 22 is a graphic representation of the flow of a valve flap relief valve without a flow vane.

Another inventive aspect of the present design utilizes a flow vane 86 projecting from the flow opening 62 and positioned in relation to the valve flap 64 to control a rate of the product flow through the flow opening 62. For the preferred embodiment, the flapper backstops 78 and the flow vane 86 are opposite sides of the same projection. As shown in FIGS. 22 and 23, the flow vanes 86 allow for adjustments to the relationship between the pressure 88 and the flow 90. Further changes to this design may utilize a curved flow vane 86 to adjust the control of the rate of the product flow through the flow opening 62. The curved surface may be positioned in accordance with the valve flap 64 and flow opening 62. The curved surface is adapted to operate with the valve flap 64 to control the rate of air flow through the flow opening 62. In the present design, the opposite side of these flow vanes 86 act as a flap backstop 78 which is positioned to limit the movement of the valve flap 64 and reduce the potential for jamming of the valve flap 64.

Through the use of the relief valve 40, the present invention teaches a further method for reducing the return of product into an upstream product flow or carrier stream caused by the eddy flow 33 within a product flow 30 inside an enclosure 26. This method includes providing an exhaust path from the enclosure 26 for the product flow 30 to be exhausted from the enclosure 26 in the area of the eddy flow 33 to reduce the effects of the eddy flow 33 in circulating products back into either a primary product flow or an initial product stream 12.

Thus, the apparatus and utilization of the apparatus of the present invention teaches methods for handling paper. The method of handling paper begins by conveying paper on a conveyor 14 and launching the paper in a main air stream across an air space 18. The method continues by deflecting the selected pieces of paper from the main air stream into a discharge chute 26 by directing air from air jets 22 against the selected pieces of paper and toward the discharge chute 26. The method continues by reducing the blow back of discharge paper from the discharge chute 26 back into the main stream by catching paper moving upward out of the discharge chute 26 with a plurality of spaced fingers 50 extending into the discharge chute.

The step of catching the paper moving upward out of the discharge chute 26 includes positioning the fingers 50 in the discharge chute 26 in the blow back of the paper moving upward out of the discharge chute 26. This step may also include combing the paper from the blow back moving upward out of the discharge chute 26 with the fingers 50 and directing the combings into the discharge chute 26 and away from the fingers 50 and the main air stream.

A further improved method of the present invention includes relieving air pressure in the discharge chute 26 with a relief valve 40 mounted in the side wall 27 of the discharge chute 26. The step of relieving air pressure may include opening the valve 40 in response to excess air pressure in the discharge chute 26. The step of relieving air pressure may also include positioning a flow vein 78 in the exhaust path of the valve 40 to control the flow through the valve 40. The step of relieving air pressure may also include preventing blocking of the valve 40 by limiting the movement of the valve 40.

The method of handling paper may also include separating the paper from the air stream with a carrier separation device 72 and directing the separated paper into the discharge chute 26 and away from the fingers 50 in the main air stream.

A further method of handling paper is described which includes conveying paper on a conveyor 14 and launching the paper in the main stream across an air space 18. The method includes deflecting selected pieces of paper from the main air stream into a discharge chute 26 by directing air jets against the selected pieces of paper and toward the discharge chute 26. The method then further comprises reducing the blow back of the discharged paper from the discharge chute 26 back into the main stream by relieving air pressure in the discharge chute 26 with a relief valve 40 mounted in the side wall 27 of the discharge chute 26.

A further method is also described which includes a method for reducing the return of a product to an initial product stream caused by an eddy flow 30 in an enclosure 26 by providing an exhaust path from the enclosure for the product flow in the area of the eddy flow.

Thus, although there have been described particular embodiments of the present invention of a new and useful Method and Apparatus for Sorting Utilizing a Product Rake and a Relief valve, it is not intended that such references be construed as limitations upon the scope of this invention except as set forth in the following claims.

What is claimed is:

1. A paper conveying system, comprising:

a first conveyer arranged to launch a main air-stream of paper across an airspace toward a primary destination;

a discharge chute located below the airspace;

an air jet directed at the airspace for diverting selected pieces of paper from the main air-stream through the airspace away from the primary destination and into the discharge chute as a primary flow; and a product rake projecting into the discharge chute at an angle to the primary flow to encourage a secondary eddy flow, the product rake adapted to prevent paper discharged into the chute from blowing back out of the chute into the main air stream by capturing paper in the secondary eddy flow.

2. The paper conveying system of claim 1, the product rake comprising:

a finger support frame attached to the discharge chute; and multiple fingers attached to the finger support frame.

3. The paper conveying system of claim 1, the primary destination comprising:

a second conveyor adapted to receive the main air-stream of paper, the first conveyor and second conveyor defining the air space as a gap between the conveyers.

4. The paper conveying system of claim 1, the discharge chute comprising:

at least one wall located below the airspace defining the discharge chute.

5. The paper conveying system of claim 4, further comprising:

a relief valve mounted in the at least one wall of the discharge chute and adapted to relieve excess air pressure in the chute and further reduce blow back of discharge paper from the chute into the main air-stream.

6. The paper conveying system of claim 1, wherein the angle is obtuse to the product flow in the discharge chute.

7. The paper conveying system of claim 1, the product rake positioned in the discharge chute to direct combings from the product rake away from the primary destination.

8. A paper conveying system, comprising:

a first conveyer arranged to launch a main air-stream of paper across an airspace toward a primary destination;

a discharge chute located below the airspace;

an air jet directed at the airspace for diverting selected pieces of paper from the main air-stream through the airspace away from the primary destination and into the discharge chute;

a product rake projecting into the discharge chute to prevent paper discharged into the chute from blowing back out of the chute into the main air stream; and an auxiliary blower adapted to provide a slight updraft at the airspace into the main air-stream of paper.

9. A paper conveying system, comprising:

a conveyer arranged to launch a main stream of paper across an airspace toward a primary destination;

a discharge chute located below the airspace, the discharge chute having a wall;

an air jet directed at the air space for diverting selected pieces of paper from the mainstream away from the primary destination and through the airspace into the discharge chute to form a discharge stream; and a relief valve mounted in the wall of the chute to relieve excess air pressure from the chute so as to reduce blow back of discharged paper from the chute into the mainstream.

10. The paper conveying system of claim 9, the relief valve comprising:

a valve frame forming a flow opening for exhausting the excess air pressure, the valve frame supportively mounted to the discharge chute; and a valve flap hingably mounted to the valve frame and adapted to cover the flow opening.

11. The paper conveying system of claim 9, the relief valve further comprising:

a flap back stop positioned in accordance with the valve flap to limit the movement of the valve flap.

12. A paper conveying system, comprising:

a conveyer arranged to launch a main stream of paper across an airspace toward a primary destination;

a discharge chute located below the airspace, the discharge chute having a wall;

an air jet directed at the air space for diverting selected pieces of paper from the mainstream away from the primary destination and through the airspace into the discharge chute to form a discharge stream;

a relief valve mounted in the wall of the chute to relieve excess air pressure from the chute so as to reduce blow back of discharged paper from the chute into the mainstream;

the relief valve comprising a valve frame forming a flow opening for exhausting the excess air pressure, the valve frame supportively mounted to the discharge chute; and a valve flap hingably mounted to the valve frame and adapted to cover the flow opening; and a flow vane projecting from the flow opening and positioned in relation to the valve flap to control a rate of the air flow through the flow opening.

13. A paper conveying system, comprising:

a conveyer arranged to launch a main stream of paper across an airspace toward a primary destination;

a discharge chute located below the airspace, the discharge chute having a wall;

an air jet directed at the air space for diverting selected pieces of paper from the mainstream away from the primary destination and through the airspace into the discharge chute to form a discharge stream;

a relief valve mounted in the wall of the chute to relieve excess air pressure from the chute so as to reduce blow back of discharged paper from the chute into the mainstream, the relief valve comprising a valve frame forming a flow opening for exhausting the excess air pressure, the valve frame supportively mounted to the discharge chute, and a valve flap hingably mounted to the valve frame and adapted to cover the flow opening; and a curved surface positioned in accordance with the valve flap and flow opening, the curved surface adapted to operate with the valve flap to control the rate of the air flow through the flow opening.

14. A paper conveying system, comprising:

a conveyer arranged to launch a main stream of paper across an airspace toward a primary destination;

a discharge chute located below the airspace, the discharge chute having a wall;

an air jet directed at the air space for diverting selected pieces of paper from the mainstream away from the primary destination and through the airspace into the discharge chute to form a discharge stream;

a relief valve mounted in the wall of the chute to relieve excess air pressure from the chute so as to reduce blow back of discharged paper from the chute into the mainstream; and a carrier-product separation device supportively mounted to the relief valve and adapted to restrict the flow of product through the relief valve.

15. The paper conveying system of claim 14, the carrier-product separation device further comprising:

a smooth surface facing the product flow and adapted to allow the product to slide off the carrier-product separation device.

16. A method of handling paper, comprising:

conveying paper on a conveyer and launching the paper in a main air-stream across an air space;

deflecting selected pieces of paper from the main air-stream into a discharge chute by directing an air jet against the selected pieces of paper and toward the discharge chute to create a primary flow; and reducing blow back discharge paper from the discharge chute back into the main stream by positioning a plurality of spaced fingers in the primary flow to encourage a secondary eddy flow, catching paper moving upward in the secondary eddy flow and out of the discharge chute with the plurality of spaced fingers extending into the discharge chute.

17. The method of handling paper of claim 16, the step of catching comprising:

positioning the fingers in the discharge chute in the blow back of the paper moving upward out of the discharge chute;

combing the paper from the blow back moving upward out of the discharge chute with the fingers; and directing the combings into the discharge chute and away from the fingers and the main air-stream.

18. The method of handling paper of claim 16, further comprising:

relieving air pressure in the discharge chute with a relief valve mounted in the wall of the discharge chute so as to reduce blow back of discharged paper from the chute into the mainstream.

19. The method of handling paper of claim 18, the step of relieving air pressure comprising:

opening the valve in response to excess air pressure in the discharge chute.

20. The method of handling paper of claim 18, the valve having an exhaust path, the step of relieving air pressure comprising:

positioning a flow vane in the exhaust path of the valve to control the flow through the valve.

21. The method of handling paper of claim 18, the step of relieving air pressure comprising:

preventing blocking of the valve by limiting the movement of valve.

22. The method of handling paper of claim 18, further comprising:

separating the paper from the air-stream with a carrier-separation device; and directing the separated paper into the discharge chute and away from the fingers and the main air-stream.

23. A method of handling paper, comprising:

conveying paper on a conveyer and launching the paper in the mainstream across an air space;

deflecting selected pieces of paper from the main air stream into a discharge chute, by directing an air jet against the selected pieces of paper and toward the discharge chute; and reducing blow back of discharge paper from the discharge chute back into the main stream, by relieving air pressure in the discharge chute with a relief valve mounted in the side wall of the discharge chute.

24. The method of handling paper of claim 23, the step of relieving air pressure comprising:

positioning a flow vane in exhaust path of the valve to control the flow through the valve.

25. The method of handling paper of claim 23, the step of relieving air pressure comprising:

preventing blocking of the valve by limiting the movement of valve.

26. A method of handling paper, comprising:

conveying paper on a conveyer and launching the paper in the mainstream across an air space;

deflecting selected pieces of paper from the main air stream into a discharge chute, by directing an air jet against the selected pieces of paper and toward the discharge chute;

reducing blow back of discharge paper from the discharge chute back into the main stream, by relieving air pressure in the discharge chute with a relief valve mounted in the side wall of the discharge chute; and opening the valve in response to excess air pressure in the discharge chute.

27. A method for reducing the return of a product to an initial product stream caused by an eddy flow in an enclosure with a primary discharge exhaust, the method comprising:

providing a supplemental exhaust path from the enclosure for the product flow in the area of the eddy flow.

* * * * *